United States Patent [19]

Larson

[11] Patent Number: 4,774,927

[45] Date of Patent: Oct. 4, 1988

[54] COMPOUND ARCHERY BOWS

[75] Inventor: Marlow Larson, Ogden, Utah

[73] Assignee: Browning, Morgan, Utah

[21] Appl. No.: 12,799

[22] Filed: Feb. 9, 1987

Related U.S. Application Data

[63] Continuation-in-part of Ser. No. 676,740, Nov. 29, 1984, Pat. No. 4,686,955, and a continuation-in-part of Ser. No. 236,781, Feb. 23, 1981, Pat. No. 4,748,962.

[51] Int. Cl.[4] ..... F41B 5/00

[52] U.S. Cl. ..... 124/23 R; 124/DIG. 1

[58] Field of Search ..... 124/23 R, 24 R, DIG. 1, 124/86, 88, 90; 74/517; 474/112

[56] References Cited

U.S. PATENT DOCUMENTS

| | | | |
|---|---|---|---|
| 3,486,495 | 12/1969 | Allen | 124/24 R |
| 3,958,551 | 5/1976 | Ketchum | 124/24 R |
| 4,060,066 | 11/1977 | Kudlacek | 124/23 R |
| 4,337,749 | 7/1982 | Barna | 124/24 R |
| 4,338,910 | 7/1982 | Darlington | 124/24 R |
| 4,368,718 | 1/1983 | Simonds et al. | 124/23 R |
| 4,515,142 | 5/1985 | Nurney | 124/23 R |
| 4,519,374 | 5/1985 | Miller | 124/23 R |
| 4,660,536 | 4/1987 | McPherson | 124/24 R |

OTHER PUBLICATIONS

Advertisement of Martin Archery, Inc. from Jul. 1984 issue of Archery World Magazine.

Article by Norb Mullaney from the Dec./Jan. 1983 issue of Archery World Magazine pp. 38–42 entitled "Super Fast, Simple, Versatile Indian Xi288".

*Primary Examiner*—Randolph A. Reese

*Assistant Examiner*—John A. Ricci

*Attorney, Agent, or Firm*—Trask, Britt & Rossa

[57] ABSTRACT

Eccentrics for a compound bow are provided with a string sheave and a cable sheave, at least one of which is provided in segments adjustable to alter the course of the cam ratio effected through the eccentric. Ideally, the portion of the cable sheave corresponding with post peak force-draw positions is adjustable to alter the separation of the cable from the pivot axis of the eccentric at the valley position of draw.

20 Claims, 5 Drawing Sheets

COMPOUND ARCHERY BOWS

RELATED APPLICATIONS

This invention is a continuation-in-part of commonly assigned Ser. No. 676,740, filed Nov. 29, 1984, now U.S. Pat. No. 4,686,955, and a continuation-in-part Ser. No. 236,781 filed Feb. 23, 1981, now U.S. Pat. No. 4,748,962, the disclosures of which are incorporated by reference herein. The earlier filed parent application is directed to an improved eccentric which combines the advantages of "side-by-side" and "step-down" eccentrics. The later filed parent application is directed to a further improved eccentric, which among other things, modifies the shape of the force-draw curve characteristic of a bow. The present invention is directed to a further improvement, whereby the force-draw curve characteristic of a bow may be modified by adjusting an eccentric with the bow in strung condition.

BACKGROUND OF THE INVENTION

1. Field

This invention pertains to compound archery bows, and is more particularly directed to the eccentric members associated with the flexible limbs of such bows.

2. State of the Art

Archery bows of the type commonly known as "compound bows" are generally characterized by a pair of flexible limbs extending from opposite ends of a handle. The tips of the limbs are thus spaced apart in relationship to each other in a fashion similar to the limb tips of a traditional stick bow. The limbs are deflected by the operation of a bowstring in the same fashion as a traditional bow, but the bowstring is interconnected to the limbs through a rigging system including mechanical advantage-varying structures (usually sheaves, such as those commonly referred to as "eccentrics") and tension runs which transfer a multiple of the bowstring tension to the respective limbs. Tension runs are interchangeably and loosely referred to by those skilled in the art as "cables," "cable stretches," "bowstring end stretches" and "end stretches." In any event, the rigging system may be regarded as a block and tackle arrangement whereby pulling force applied to the bowstring (at its nocking point) is transferred to the limb tips to flex the limbs. The bowstring and tension runs may comprise a single continuous loop, but more typically, the bowstring is constructed of special bowstring material, while the tension runs are of more rugged construction, e.g. as from aircraft cable. The bowstring and tension runs together are referred to interchangeably as the "cable system," "cable loop" or "rigging loop."

The rigging of a compound bow functions as a block and tackle to provide a mechanical advantage between the force applied to the bowstring by an archer and the force applied to the bow limbs. In other words, in operation, the nocking point of the bowstring is moved a longer distance than the total distance that the two limb tips move from their braced position. Although other configurations are possible, an eccentric sheave is usually pivotally mounted at each limb tip. If the eccentrics are mounted elsewhere, the rigging usually includes a concentric pulley at each limb tip.

The term "sheave" is intended in this disclosure to include any structure mountable to rotate about an axis to present a winding surface analogous to a pulley, wheel or drum. The term thus includes elements common to the structures known within the archery art as compound bow "eccentrics," "cams," "wheels" and the like. As so defined, an eccentric may include one or more sheaves, each of which includes one or more "grooves." Depending upon their individual functions, these grooves are called either "string grooves" or "cable grooves." The grooves are regarded as being provided in the surface of the sheave, although it sometimes occurs that the depth of a groove may increase as it progresses about the axis of the sheave so that the bottom of the groove approaches the axis more rapidly than does the outer surface of the sheave. The string grooves of an eccentric comprise a "string track," and the cable grooves comprise a "cable track."

Each sheave of an eccentric thus has grooves or tracks analogous to the pulley grooves in a block of a traditional block and tackle. A string track is arranged alternately to pay out or take up string (or the portion of the cable directly linked to the string) as the limbs are alternately flexed to drawn or relaxed to braced condition. A cable track is arranged alternately to take up portions of the tension run (as string is paid out while the eccentric pivots to drawn condition) and to pay out portions of the tension run (as string is wound onto the string track while the eccentric pivots to braced condition). In some instances, either the cable sheave or the string sheave may actually be concentric with respect to the axle of the eccentric.

For purposes of this disclosure, it is recognized that in the operation of a compound bow, the portion of the rigging called the bowstring actually lengthens as the string is pulled back because as the eccentrics pivot from their braced condition, portions of the bowstring stored in the string tracks unwind and are paid out. Concurrently, portions of the tension run are wound onto the cable tracks of the eccentrics so that the tension runs descrease in length. The opposite phenomenon occurs as the string is released, permitting the eccentrics to pivot back to their braced condition. Assuming that the eccentrics are carried by the respective limb tips, the portion of the rigging loop extending between points of tangency of the bowstring with the string track of the eccentrics will be referred to herein as the "central stretch" of the bowstring. The bowstring shall be considered to include, in addition to the central stretch (sometimes called the "working stretch"), portions of the rigging loop stored at any time in association with the string tracks of the eccentrics. The portions of the rigging loop extending from the points of tangency of the tension stretches with the cable tracks of the eccentrics to remove points of attachment to the bow shall be called the "end stretches." Each tension run is considered to include, in addition to an end stretch, the portion of the rigging loop extending from the end stretch and wrapped within or otherwise stored in association with the cable track of the associated eccentric.

In an archery bow of the type commonly referred to as a "compound bow," the shape of the force-draw curve is determined in substantial part by the "cam ratio" of the rigging as a function of draw (movement of the nocking point from its at rest position). The "cam ratio" is defined as the ratio of the distance measured from the axis of an eccentric of the rigging to the tangent point of contact of the bowstring with the string groove to the corresponding distance between the axis and the tangent point of contact of the cable with the cable groove of that eccentric. Various combinations and configurations of string grooves and cable grooves are disclosed, for example, by U.S. Pat. Nos. 3,486,495; 3,958,551; 4,060,066; 4,337,749; and 4,338,910. These configurations influence the course of the "cam ratio" of the rigging of a bow as the nocking point is pulled from braced condition to various drawn positions.

Each bow may be described by reference to a specified "draw length," at or near the "valley" of its force-draw curve. Heretofore, it has not been conveniently available to adjust the draw length of a compound bow without indirectly affecting the location (draw position) and/or magnitude of the peak draw force of the bow. Adjustments to draw length have conventionally involved adjusting the rotational positioning of the eccentrics on their axes. The course of the "cam ratio" of the rigging as a function of draw has inherently been simultaneously affected. Adjusting the draw length of a bow has also necessitated loosening the rigging and restringing the bow.

Eccentrics have recently become available which include interchangeable segments. These segments may be used to restructure the eccentric to reprogram the course of the cable track, thereby adjusting the draw length of a bow outfitted with such eccentrics. The segments may be changed with the bow in strung condition. It would be an important advancement in the art to provide a rigging for a compound bow permitting independent adjustment of draw length and/or "let-off" and peak draw force. As a corollary, it would be a significant benefit to be able to adjust the draw length of a compound bow (providing for approximately minimum post peak draw force at an individual archer's "full draw" length) while the bow is in its strung condition.

SUMMARY OF THE INVENTION

The present invention provides an improved eccentric element for the rigging system of "compound bows." The eccentrics of this invention may be used in place of more conventional eccentrics in any of the various configurations of compound bows heretofore known in the archery art. The principles of operation of this invention may be understood, and are conveniently described, with reference to a bow in which a pair of resilient limbs are deflected by the operation of a bowstring interconnected to the distal ends (or tips) of the limbs through a three-line lacing (rigging) including an eccentric of this invention pivotally mounted at each limb tip. The eccentrics may be referred to as the "upper eccentric" and "lower eccentric," respectively, having reference to their relative positioning when the handle of the bow is grasped by the archer in a normal shooting position. (That is, with the limbs held approximately vertically.) According to this invention, the upper eccentric may be a reverse ("mirror image") of the lower eccentric.

Each eccentric includes at least two sheave portions. The first such portion (string sheave) accommodates one end of the bowstring or central stretch in a bowstring-engaging track which is usually (but not necessarily) of circular configuration. The second portion (cable sheave) accommodates a tension run or end stretch in a tension run-engaging track which is usually of (but not necessarily) non-circular configuration. The first and second tracks are arranged with respect to each other to effect a varying "cam ratio" (as previously defined in this disclosure) between the points of tangency of the central stretch and the end stretch with the eccentric. The larger the "cam ratio", the greater the mechanical advantage effected through the eccentric.

The step-down take-up cable ramp described in the aforesaid parent application Ser. No. 236,781 may, but need not, be incorporated in the eccentric of the present invention. This ramp functions to move the portion of the tension run adjacent the cable track down towards the axis (axle) of the eccentric and laterally towards the string track of the eccentric as the eccentric pivots towards its drawn condition. As the eccentrics are permitted to pivot back towards braced condition (the drawn bowstring is released), this portion of the tension run is carried laterally away from the string, thereby to afford vane clearance for a launched arrow.

According to this invention at least one of the sheaves, usually the cable sheave, is provided in segments. To avoid redundancy, this disclosure is directed to embodiments in which the string sheave is integral, and the cable sheave is segmented. It should be understood, however, that similar features can be incorporated in the string sheave instead of, or as well as, the cable sheave.

A first segment of the cable sheave is arranged with respect to the string sheave so that when the bow is in a predetermined draw condition (most conveniently its at rest, strung condition), the cable is in contact with it, and out of contact with the remainder of the cable sheave. The portion of the cable sheave not included in the first segment includes the portion of the cable track contacted by the cable when the nocking point of the bowstring is drawn to a different distance. This portion of the cable track can be altered in configuration without disturbing the first segment. Either or both the specified draw length of the bow or the percentage of "let-off" of the bow between peak holding force and the holding force at a specified draw length may be modified in this fashion.

Of most significance from the standpoint of this invention, is the relocation of the rotational orientation of the portion of the cable groove coresponding to the commencement of "let-off" without altering the rotational orientation of the portions of the cable groove corresponding to the portion of the force-draw curve characteristic of the bow through peak force. Also of significance is the capability of selecting the distance of separation of the cable groove corresponding to the valley of the force-draw curve from the axle axis of the eccentric. Reducing this separation effects a greater "let-off" in the holding force at the valley without significantly affecting the velocity of an arrow cast by the bow drawn to the valley position.

Typically, a first segment of the cable sheave is fixed to the string sheave and a second segment of the cable sheave is movable to various orientations with respect to the first segment. The first segment includes a peripheral groove which constitutes a portion of the cable track. The second segment also includes a peripheral groove which constitutes the remainder of the cable track. The groove of the second segment is so configurated that as this segment is reoriented with respect to the first segment, the configuration of the cable track is thereby changed. As a consequence, the course of the "cam ratio" of the eccentric may be reprogrammed as desired by selecting among various available orientations of the second segment.

Although various configurations for the first and second segments of the cable sheave are within contemplation, a preferred design utilizes a second segment which includes the portion of the cable track which contacts the cable at the stages of draw following the occurrence of peak holding force. This segment may be mounted to rotate about an axis which is located at various radial distances with respect to the individual point locations of its peripheral cable groove. It is presently preferred to utilize a circular string track peripheral to a circular string sheave. In that event, it is generally most convenient for the second segment of the cable sheave to rotate with respect to the central axis of the string sheave. Means are provided to avoid interference with the pivot axis of the eccentric as the segments of the cable sheave are reoriented with respect to each other. Ideally, the second segment of the cable sheave may be configurated as an approximately annular ring mounted to turn on a central post. The post may include an axis for the pivotal mounting of the eccentric. It may also include means for releasing and locking the second segment in its rotational orientation with regard to the first segment. The outer perimeter of the annular ring carries a groove, portions of which are selectively positionable to register with the groove carried by the first sgement. The groove of the annular ring is configurated as needed to establish the desired course of the mechanical advantage provided by the rigging. The first segment may be configurated as an outer annular segment approximately concentric with a portion of the annular ring and post.

The adjustability of the force-draw curves which can be developed through the use of the eccentrics of this invention offers several advantages. A desired initial slope of the force-draw curve can be fixed (designed into the rigging) without regard to the draw length that may ultimately be desired in the field. The draw length characteristic of a particular compound bow can be varied substantially without significantly altering either the peak force or "let-off" characteristics of that bow. Other embodiments provide for the selection between alternative "let-off" characteristics as well as draw length characteristics without altering the peak force characteristics. Peak force may be independently adjusted in many conventional bows by means of limb bolts without significantly affecting either peak force or "let-off" valves.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
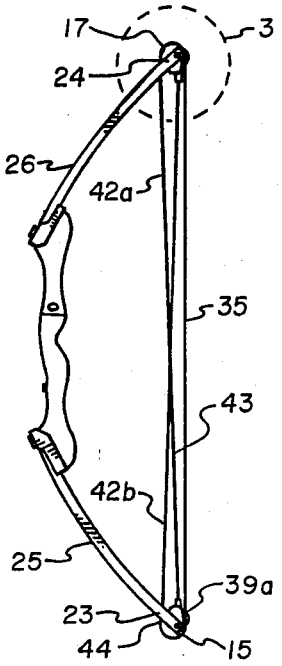
FIG. 1 is a view in elevation of an archery bow showing a pair of eccentrics of this invention mounted in their normal position of use. The bow is shown in braced condition.
Figure 3:
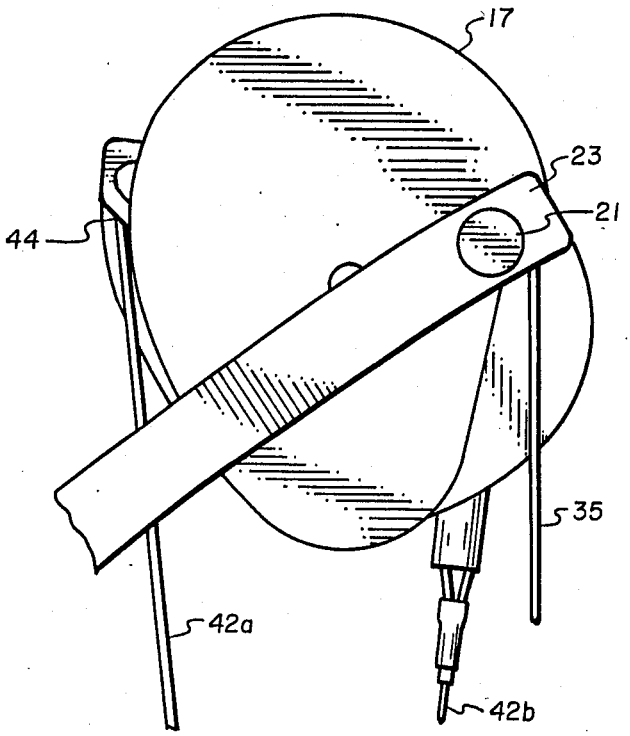
FIG. 3 is an enlargement of a portion of FIG. 1.

FIG. 1 illustrates a typical bow which includes a lower eccentric 15 and an upper eccentric 17. These eccentrics are substantially similar except that they are reversed in configuration. Each eccentric 15, 17 is provided with a pivot hole (journal) 19 (FIG. 4) which accommodates an axle 21 (FIG. 3) by which it is pivotally mounted to the distal ends 23, 24, respectively, of limbs 25 and 26. The specific embodiments described hereinafter with reference to FIGS. 4 through 12 are illustrated as lower eccentrics of a bow intended for right handed archers. The eccentric illustrated by FIG. 3 is an upper eccentric for right handed archers.

Figure 2:
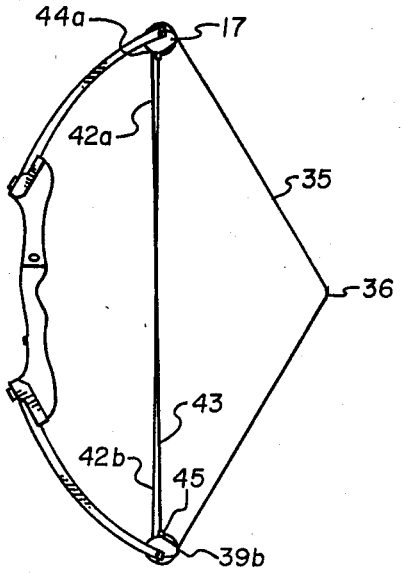
FIG. 2 is similar to FIG. 1, but shows the bow in drawn condition.

The operation of the eccentrics to let out and take up string and cable is explained in detail in the aforementioned parent applications, the disclosures of which are incorporated herein by reference. Although different eccentrics are illustrated by the drawings of this invention their general function and operation are similar. In summary, each eccentric 15, 17 (FIGS. 1–3) has a first sheave portion 30 (FIG. 4) with a peripheral bowstring track in the form of a string groove 31. A portion of a bowstring 35 (FIGS. 1–3) is wound around the sheave portion 30 in string groove 31, being held in place by suitable means (not shown) conventionally used for this purpose. Comparing FIGS. 1 and 2, it is apparent that as the nocking point 36 of the string 35 is pulled toward the archer, the eccentric 17 pivots around axle 21 from braced condition (FIG. 1) to drawn condition (FIG. 2). As the eccentric 17 pivots, the wound portion of the string 35 unwinds from the string groove 31 and pays out as a lengthening of the central stretch of the bowstring 35. The central stretch is measured from the point of tangency 39A (FIG. 1), 39B (FIG. 2) of the bowstring 35 with the string groove 31. The location of this point continuously migrates during pivoting of the eccentric from braced condition (39A) to its eventual location (39B) at drawn condition.

Figure 4:
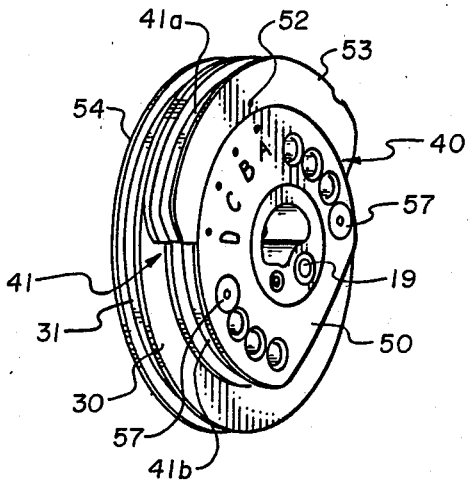
FIG. 4 is a perspective view of an alternative embodiment of this invention.

Each eccentric 15, 17 additionally includes a second sheave portion designated generally 40 (FIG. 4), with a specialized cable track, designated generally 41A (FIG. 4). The tension run 42 begins where the cable enters the cable track 41. In braced condition (FIG. 1), most of the tension run 42 is unwound and forms an end stretch 43 extending from a point of tangency 44 with the cable track 41A to a remote anchoring point 45. A relatively short portion of the tension run 42 is stored (wound) in the cable track 41A beyond the point of tangency 44. FIG. 2 illustrates the eccentric 17 in draw condition with the stored or wound portion of the tension run 42 much lengthened, thereby reducing the length of the end stretch 43. The point of tangency 44A of the tension run 42 occurs approximately 270° of rotation removed from the original location 44, having migrated continuously around the cable track 41B (FIG. 4) from its initial position 44 as the eccentric was pivoted from its braced condition.

The mechanical advantage of the rigging comprising the eccentrics 15, 17, and cable loop comprising the bowstring 35 and tension runs 42A, 42B is a function of, among other things, the "cam ratio" of the eccentrics. The "cam ratio" is determined by measuring the perpendicular distance between the axis of the axle 21 and the points of tangency 39 and 44. These perpendicular distances may be determined by direct measurement following well known analytical geometry methods. The "cam ratio" is defined as the "string distance" (21–39) divided by the "cable distance" (21–44). Thus, as illustrated, this ratio is initially less than unity at braced condition, and progressively increased in value to greater than unity at drawn condition. The rate of change of the "cam ratio" and its value at any degree of rotation with respect to its braced position is "programmed" by the shapes of the string track 31 and cable track 41 and their orientations with respect to each other.

Figure 5:
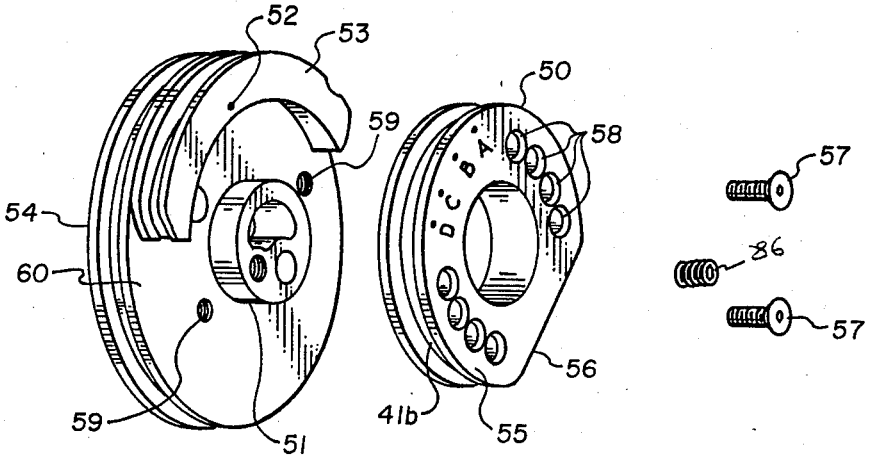
FIG. 5 is an exploded view of the embodiment of FIG. 4.
Figure 11:
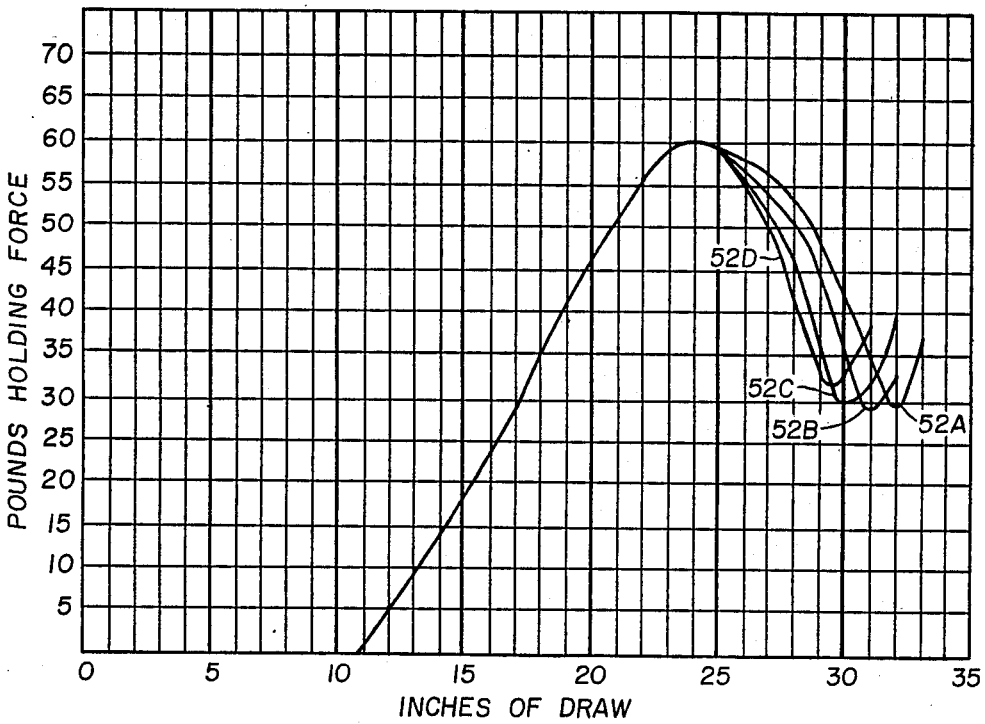
FIG. 11 is a plot of force-draw curves representative of those obtainable from a bow rigged as illustrated in FIG. 1 with eccentrics such as illustrated by FIGS. 4 and 5.

The embodiment illustrated by FIGS. 4 and 5 provides for variable draw lengths within a range of about 3 inches at a selected "let-off". It includes an annular ring member 50 rotatably mounted on a central post 51 for locking into any of four selected rotational positions, A, B, C, D, with respect to an index mark 52, which is in turn fixed with respect to a stationary cable groove segment 53 and a string sheave 54. The force-draw curves of FIG. 11 are representative of those obtained when eccentrics of the type illustrated by FIG. 4 are included at opposite limb tips of a compound bow rigged as shown in FIG. 1, and the bow is adjusted for a peak draw weight of about 60 pounds. The curve designated 52A is produced by rotating the annular ring 50 to the A index position, as illustrated. The curves designated 52B, 52C, and 52D, respectively, are produced by rotating the annular ring 50 to the corresponding respective B, C and D index positions. The portion of the cable groove 41B in the proximity of portion 55 of the ring 50 is tangent to the cable 42B at approximately a drawn distance corresponding to peak force. When the cable 42B rests in the groove 41B traversing the relatively flat portion 56 of the ring 50, the valley of the force-draw curve is experienced by the archer. The draw length at which this valley occurs is established by the rotational orientation of the ring 50 as described. The ring 50 is held in position by a pair of set screws 57 selectively positioned through appropriate bores 58 in the annular ring 50 to register with threaded bores 59 in a circular plate 60 comprising the cable segment 53 and the string sheave 54. The ring 50 may be repositioned at will with the bow in its braced condition, because in that condition, the cable 42B is held completely out of contact with the ring 50, being in contact only with the stationary segment 53.

As may be seen from FIG. 11, the degree of "let-off" of the bow is adjusted to some degree at position D, but in no event is the shape of the force-draw curve produced between the at rest and peak draw force positions of the nocking point altered by these adjustments to "let-off" and/or draw length. This portion (rest to peak) of the force-draw curves 52A, 52B, 52C, 52D is generated with the cable 42B in contact with the fixed portion 53 of the cable sheave. The variable portion (peak to valley) of the curves 52A, 52B, 52C, 52D is generated with the cable 42B in contact with the portion 41B of the cable track 41 carried on the perimeter of the annular ring 50.

Figure 6:
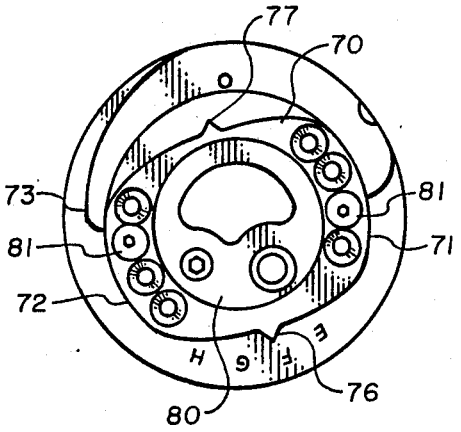
FIGS. 6, 7 and 8 are views in elevation of another embodiment of this invention.
Figure 7:
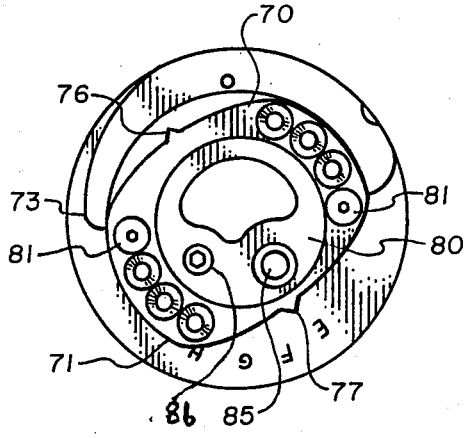
Figure 8:
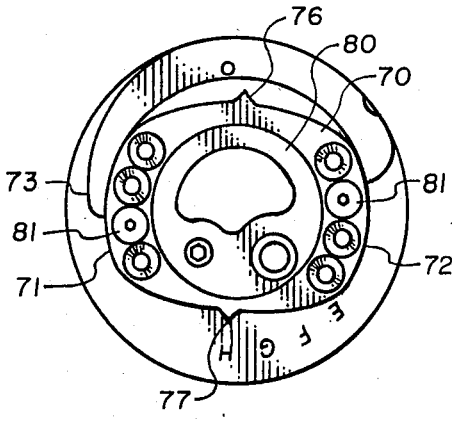
Figure 9:
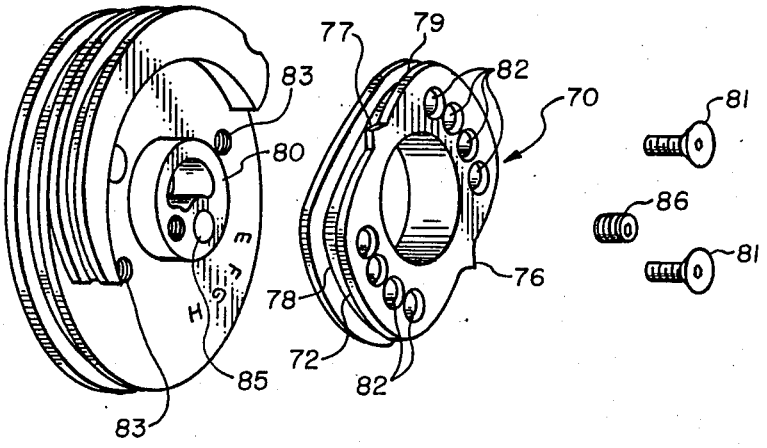
FIG. 9 is an exploded view of the embodiment of FIGS. 6, 7 and 8.

The embodiment illustrated by FIGS. 6 through 9 provides, in a fashion similar to that discussed in connection with the embodiment of FIGS. 4 and 5, for varying draw lengths. It further provides for adjustable "let-off." The approximately annular ring 70 includes alternative cable-contact surfaces 71, 72, either of which may be positioned in the proximity of the trailing portion 73 of the cable track. The ring 70 may selectively be rotated to bring one of the index pointers 76, 77 into registration with any of the index marks E, F, G, H. Referring to FIG. 6, with index pointer 76 in registration with index mark F, for example, the cable 42B (FIG. 1) is brought into contact with a cable groove 78 (FIG. 9) on the surface 72 once the nocking point 36 is drawn to beyond its peak draw force position (24 inches FIG. 12). With the ring 70 rotated approximately 180° (FIG. 7), index pointer 77 is brought into registration with the same index mark F, but the cable 42B now contacts a groove 79 (FIG. 9) on the surface 71 as the nocking point 36 is pulled beyond its peak draw force position. The ring 70 is held in rotational position with respect to the post 80 by means of screws 81 placed selectively through appropriate bores 82 in the ring 70 to register with threaded holes 83. The post 80 caries a pivot hole and bearing 85. As shown, a set screw 86 constitutes means for securing a bowstring to the post 80.

Figure 12:
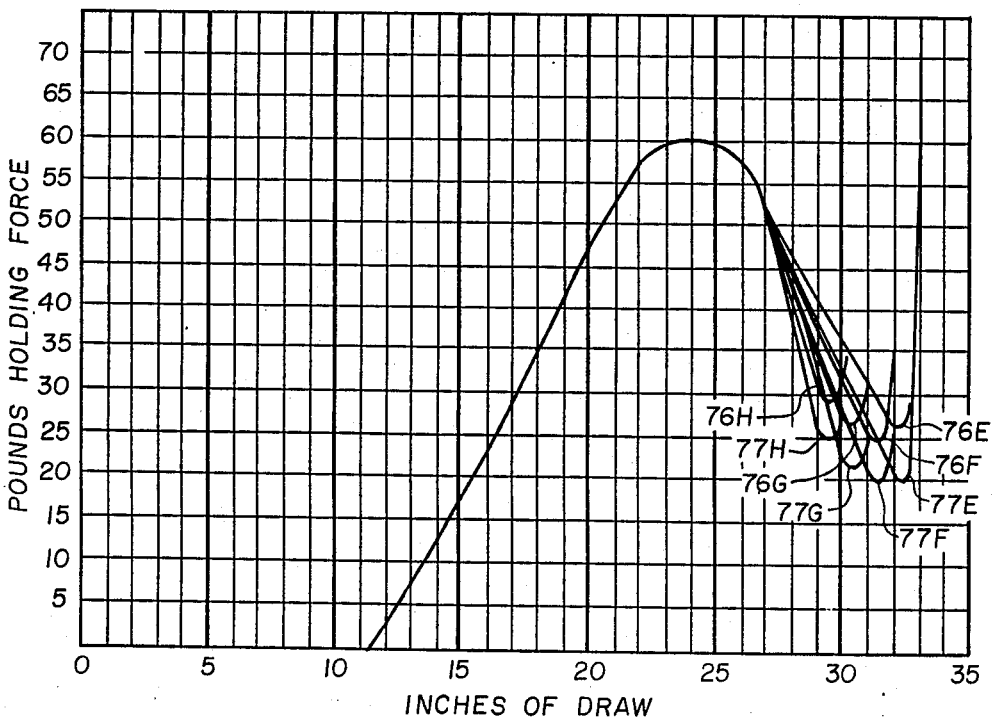
FIG. 12 is a plot of force-draw curves representative of those obtainable from a bow rigged as illustrated by FIG. 1 with eccentrics such as illustrated by FIGS. 6 through 9.

Force-draw curves representative of a bow with eccentrics arranged and adjusted as illustrated by FIGS. 6–9 are shown by the curves of FIG. 12. FIG. 12 includes two families of curves illustrating respective force-draw curves resulting from each of the possible index positions of the eccentrics illustrated by FIG. 6 through 9. Curves 76 E, F, G and H correspond to the force-draw curves of a bow rigged as illustrated by FIG. 1 with the eccentrics of FIGS. 6 through 9 with the index pointer 76 set at index marks E, F, G and H, respectively. Curves 77 E, F, G, and H are corresponding curves with the index pointer 77 set at index mark E, F, G and H, respectively.

Figure 10:
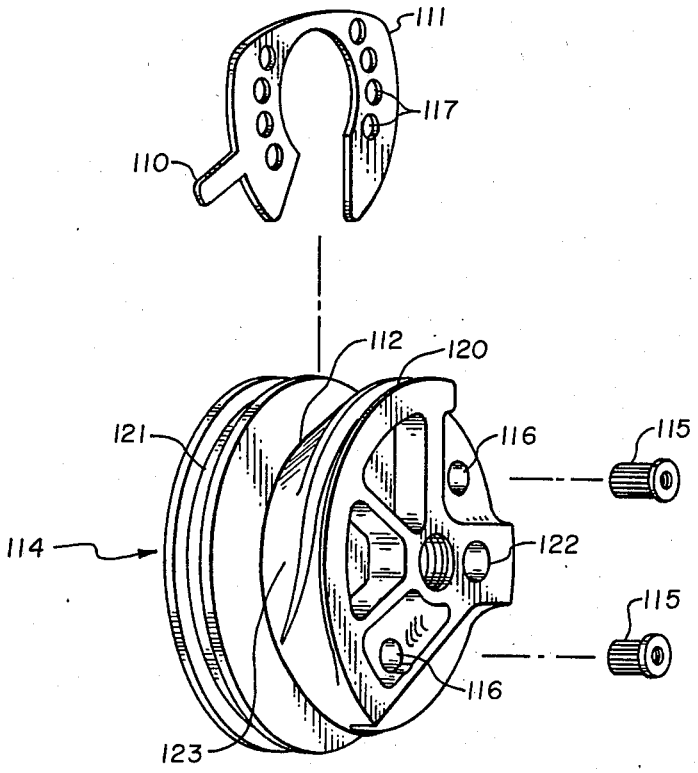
FIG. 10 is an exploded view of another embodiment of the invention.

FIG. 10 illustrates a further embodiment of the invention wherein the configurations of the cable groove may be adjusted by movement of the lever 110 to rotate the disc 111. The configurations of the groove 112, and thus the draw length of a bow equipped with such eccentrics 114, may be made infinitely adjustable between significant limits of several inches. As shown, threaded inserts 115 are placed in bores 116 to register with holes 117 in the disc 111, thereby to fix its rotational orientation with respect to a fixed segment 120 of the cable groove 112.

The string track, as illustrated, may be regarded as defining a plane of intersection through the string groove 121 which is approximately normal and transverse the axis of the axle hole 122. The cable track includes the braced cable segment 120 of relatively large effective radius, a drawn cable groove 112 of relatively small effective radius, and a step-down, take-up cable ramp 123 connecting the two cable grooves 120, 112. The cable track of this embodiment thus functions to force the tension run 42 transversely over towards the middle of the limb 25 (thereby reducing the twisting moments which would otherwise be applied to the limbs), and down towards the axle 21 (thereby tending to increase the "cam ratio" of the eccentric near full drawn condition). The "cam ratio" following peak draw force position is further modified by the rotational orientation of the disc 111 in the same fashion as described in connection with the other embodiments of the invention.

Reference herein to certain details of the illustrated embodiments is not intended to limit the scope of the appended claims which in themselves recite those features of the invention regarded as significant.

I claim:

1. In an archery bow of the type in which a bowstring is interconnected to a pair of limbs through a rigging system including eccentrics pivotally mounted in operable association with the limbs, each eccentric including a bowstring-engaging track and a tension run-engaging track, said rigging system including a central stretch extending from a point of tangency with said bowstring-engaging track and an end stretch extending from a point of tangency with said tension run-engaging track, an improved eccentric, comprising:

a string sheave carrying such a bowstring-engaging track;

a cable sheave carrying such a tension run-engaging track;

said tracks being arranged to effect a varying "cam ratio" between said points of tangency as said eccentric pivots on its axis in response to operation of such a rigging;

one of said sheaves being provided in segments, each of which carries a groove comprising a portion of one of said tracks, at least one of said segments being movable between selected orientations to change the configuration of the track comprised of said grooves, thereby changing the course of the "cam ratio" effected by said eccentric as said eccentric pivots on its axis.

2. An improvement according to claim 1 wherein said sheave provided in segments is said cable sheave.

3. An improvement according to claim 2 wherein said cable sheave includes:

a first segment arranged to receive cable as the eccentric pivots from its braced position to a position approximately corresponding to its peak draw force position in said rigging; and a second segment arranged to receive cable as the eccentric pivots from said position approximately corresponding to its said peak draw force position, to subsequent, post peak draw force pivoted positions.

4. An improvement according to claim 3 wherein said second segment is movable with respect to said first segment while said first segment is maintained fixed with respect to said string sheave.

5. An improvement according to claim 4 including structure integral with said string sheave for mounting said second segment, said structure including an axle journal adapted to receive an axle associated with a bow limb.

6. An improvement according to claim 5 wherein said second segment is coupled to said structure so that it may be moved to a position the cable groove contacted by said end stretch when the eccentric is pivoted to the position corresponding to the valley of the force draw curve of the bow at selected distances from said axle journal.

7. An improvement according to claim 4 wherein said string sheave includes a pivot axis, a peripheral string groove defining a plane which intersects said pivot axis, a post parallel said pivot axis and an approximately annular element with a first peripheral cable groove defining a plane approximately parallel said string groove, said annular element being rotatably mounted on said post.

8. An improvement according to claim 7 wherein said annular element is comprised of said second segment, and said first segment carries a second peripheral cable groove in the plane defined by said first peripheral cable groove, the smallest distance of said second peripheral cable groove from said pivot axis being larger than the largest distance of said first peripheral cable groove from said pivot axis.

9. An improvement according to claim 8 wherein said string sheave is approximately cylindrical, said second segment is an annular segment defined by concentric cylindrical surfaces and said annular element is mounted between said post and said second segment so that as it is rotated on said post, selected portions of said first peripheral cable groove are brought into registration with said second peripheral cable groove and including means for locking said annular segment into a selected rotational orientation.

10. An improvement according to claim 9 wherein said post is approximately cylindrical and includes an axle journal concentric with said pivot axis.

11. An improvement according to claim 10 wherein said post is approximately concentric with said string sheave and said second segment of said cable sheave.

12. In an archery bow of the type that includes resilient limbs which are deflected from their braced position to drawn positions by the operation of a bowstring interconnected to the limbs through rigging including eccentric members which provide a varying "cam ratio" and further including tension runs opposite the bowstring with respect to the eccentrics, an improved rigging which comprises:

an eccentric member, with structure constituting means for providing pivotal connection of said eccentric about an axis, in operable association with a resilient limb, said eccentric member including:

a first, bowstring-engaging track with a plane of intersection transverse and approximately normal said axis constituting means for storing a portion of a bowstring when the bow limb is in its braced position and for paying out a portion of the bowstring as the bowstring is pulled to pivot the eccentric, thereby to deflect said limb, and a second, tension run-engaging track, constituting means for taking up and storing a portion of a tension run as said bowstring is pulled to pivot the eccentric, including a braced groove of relatively large radius, a drawn groove of relatively small radius, and an intermediate groove of varying radius connecting said braced and drawn grooves such that as the bowstring is pulled from braced to drawn position, the tangent point of contact of said tension run with said eccentric migrates from said braced groove across said intermediate groove towards said axis to said drawn groove;

said drawn groove being carried by structure movable with respect to said braced groove to alter the configuration of said tension run-engaging track.

13. An eccentric member according to claim 12 wherein both the bowstring-engaging track and the tension run-engaging track are non-circular, and the major diameters of said tracks are nonparallel.

14. An eccentric member according to claim 12 including a ramp surface which comprises said intermediate groove constituting means whereby as said tangent point migrates across said intermediate groove, it migrates over towards said bowstring-engaging track.

15. An eccentric member according to claim 14 wherein both the bowstring-engaging track and the tension run-engaging track are non-circular, and the major diameters of said tracks are nonparallel.

16. An eccentric member according to claim 12 wherein said structure movable with respect to said braced groove is adapted for movement to selected fixed rotational orientations, thereby to position said drawn groove at corresponding selected distances from said axis when said eccentric is pivoted to effect contact of said drawn groove by said tension run.

17. An eccentric member according to claim 12 wherein said first track is carried by a first sheave and said second track is carried by a second sheave including a first segment fixed with respect to said first sheave and a second segment movable with respect to said first sheave.

18. An eccentric member according to claim 17 wherein said drawn groove is carried by said second segment.

19. An eccentric member according to claim 18 including structure integral with said first sheave adapted to removably fix said second segment into selected rotational orientations with respect to said first segment.

20. An eccentric member according to claim 19 wherein said structure includes an approximately cylindrical post and said second segment is formed as an approximately annular member mounted to rotate on said post.

* * * * *